US006776702B1

(12) United States Patent
Ashford et al.

(10) Patent No.: US 6,776,702 B1
(45) Date of Patent: Aug. 17, 2004

(54) COIN PAYOUT DEVICE

(75) Inventors: Paul Richard Ashford, Bury (GB); Anthony Edward Morrison, Rochdale (GB); Nicholas John Aspinall, Leigh (GB); Gary John Anderson, Oldham (GB)

(73) Assignee: Coin Acceptors, Inc., St. Louis, MO (US)

( * ) Notice: Subject to any disclaimer, the term of this patent is extended or adjusted under 35 U.S.C. 154(b) by 41 days.

(21) Appl. No.: 10/129,597

(22) PCT Filed: Nov. 9, 2000

(86) PCT No.: PCT/GB00/04296

§ 371 (c)(1),
(2), (4) Date: Feb. 14, 2003

(87) PCT Pub. No.: WO01/37227

PCT Pub. Date: May 25, 2001

(30) Foreign Application Priority Data

Nov. 19, 1999 (GB) ..... 9927441

(51) Int. Cl.[7] ..... G07D 1/00
(52) U.S. Cl. ..... 453/41; 453/49
(58) Field of Search ..... 453/1, 2, 21, 23, 453/24, 25, 37, 41, 43, 44; 194/200

(56) References Cited

U.S. PATENT DOCUMENTS

| | | | | |
|---|---|---|---|---|
| 2,525,718 A | | 10/1950 | Adams et al. | 194/10 |
| 3,082,852 A | | 3/1963 | Melvin et al. | 194/10 |
| 3,640,292 A | | 2/1972 | Clairmonte | 133/5 |
| 4,284,093 A | * | 8/1981 | Hayashi | 453/21 |
| 5,316,517 A | | 5/1994 | Chiba et al. | 453/57 |

FOREIGN PATENT DOCUMENTS

| | | | | |
|---|---|---|---|---|
| GB | 2 117 954 A | | 10/1983 | G07D/1/04 |
| WO | WO-98/00816 | * | 1/1998 | G07D/9/00 |
| WO | 98/00816 | | 8/1998 | |

OTHER PUBLICATIONS

International Search Report, Feb. 19, 2001.
UK Search Report, May 10, 2000.

* cited by examiner

*Primary Examiner*—Donald P. Walsh
*Assistant Examiner*—Mark J. Beauchaine
(74) *Attorney, Agent, or Firm*—Polster, Lieder, Woodruff & Lucchesi, L.C.

(57) ABSTRACT

A coin payout device has a slider with a coin receiving hole for receiving a coin. The slider is reciprocable between a first position whereat the hole is at a coin discharging station and a second position whereat the hole is at a coin receiving station. A rotary coin orienting device is located at the coin receiving station for orienting coins parallel to the hole by a rotary action. A motor drives the slider from the first position to the second position and simultaneously rotates the rotary coin orienting device. In order to prevent damage in the event of jams, the motor is not used to drive the slider from the second position to the first position and instead springs are used.

16 Claims, 6 Drawing Sheets

COIN PAYOUT DEVICE

DESCRIPTION

1. Field of the Invention

The present invention relates to a coin payout device.

2. Background of the Invention

Coin payout devices are used in money changing and vending machines for delivering coins to a user. A known form of payout device employs a slider with a hole for receiving a coin to be paid out. The slider is driven by a solenoid or a rotary motor and reciprocates between a first station, at which a coin enters the hole from above, and a second station where the coin can fall out of the hole. The hole is arranged so that only one coin can be accommodated at a time.

A problem arises with this form of payout device in that coins occasionally do not lie flat in the hole causing the slider to jam. This renders the device inoperative and may cause damage, e.g, burning out of the motor and bending of drive train components. This problem has been found to be exacerbated by the provision of coin orienting means for orienting coins for reception by the slider. Such orienting means are not known to be comprised in the state of the art. Furthermore, it has been found desirable that the orienting means continue to be driven in the event of a jam.

SUMMARY OF THE INVENTION

According to the present invention, there is provided a coin payout device comprising a transport member having a coin receiving hole in a face thereof for receiving a coin, the transport member being reciprocable between a first position whereat the hole is at a coin discharging station and a second position whereat the hole is at a coin receiving station, coin orienting means at the coin receiving station for orienting coins for reception by said hole, and a drive means including a rotary prime mover, for driving the transport member from the first position to the second position and for driving the orienting means, wherein the drive means is arranged such that the prime mover will continue to rotate harmlessly, driving the orienting means, when the transport member becomes jammed.

Consequently, the drive means can continue to operate and will eventually start to drive the transport member back to the second position, freeing the jam and giving a jamming coin the chance to settle properly in the hole. Thus, a jam does not inevitably render the apparatus inoperative.

The prime mover is preferably an electric motor.

The drive means may couple the prime mover to the transport member by a force-sensitive releasable coupling or an elastic coupling. Preferably, however, means for gaining potential energy by means of the powered drive means during driving the transport member from the first position to the second position is provided and the means for gaining potential energy is used to drive the transport member between the second position and the first position. In this case, the drive means may merely push against the transport member, e.g. by means of a cam or a crank, when moving it towards the second position, with any contact between the two, when the transport member is moving towards the second position, being a result of the gained potential energy being expended in moving the transport member. More preferably, the means for gaining potential energy comprises a mechanical energy storage device such as spring means. However, it could be the transport member itself which would gain potential energy by being moved against gravity by the powered drive means.

The transport member may be arranged such that an opening of the hole is not in a vertical plane. More preferably, the transport member is planar and the hole extends fully through the transport member. Still more preferably, the coin receiving station comprises a coin delivery path for supplying coins on the upper side of the transport member and a wall closing the hole on the under side of the transport member and/or the hole is open at the under side of the transport member at the coin discharge station so that a coin therein can fall out of the hole.

The coin orienting means may comprise a rotary ring which may have a tapering passage extends through it, the tapering passage having a circular opening for discharging coins to the transport member and an opening having a periphery in the form of a spiral for receiving coins from a hopper.

Preferably, the orienting means includes a coin agitating projection for agitating coins in a hopper supplying coins to the device.

BRIEF DESCRIPTION OF THE DRAWINGS

An embodiment of the present invention will now be described, by way of example, with reference to the accompanying drawings, in which.

DETAILED DESCRIPTION

Figure 1:
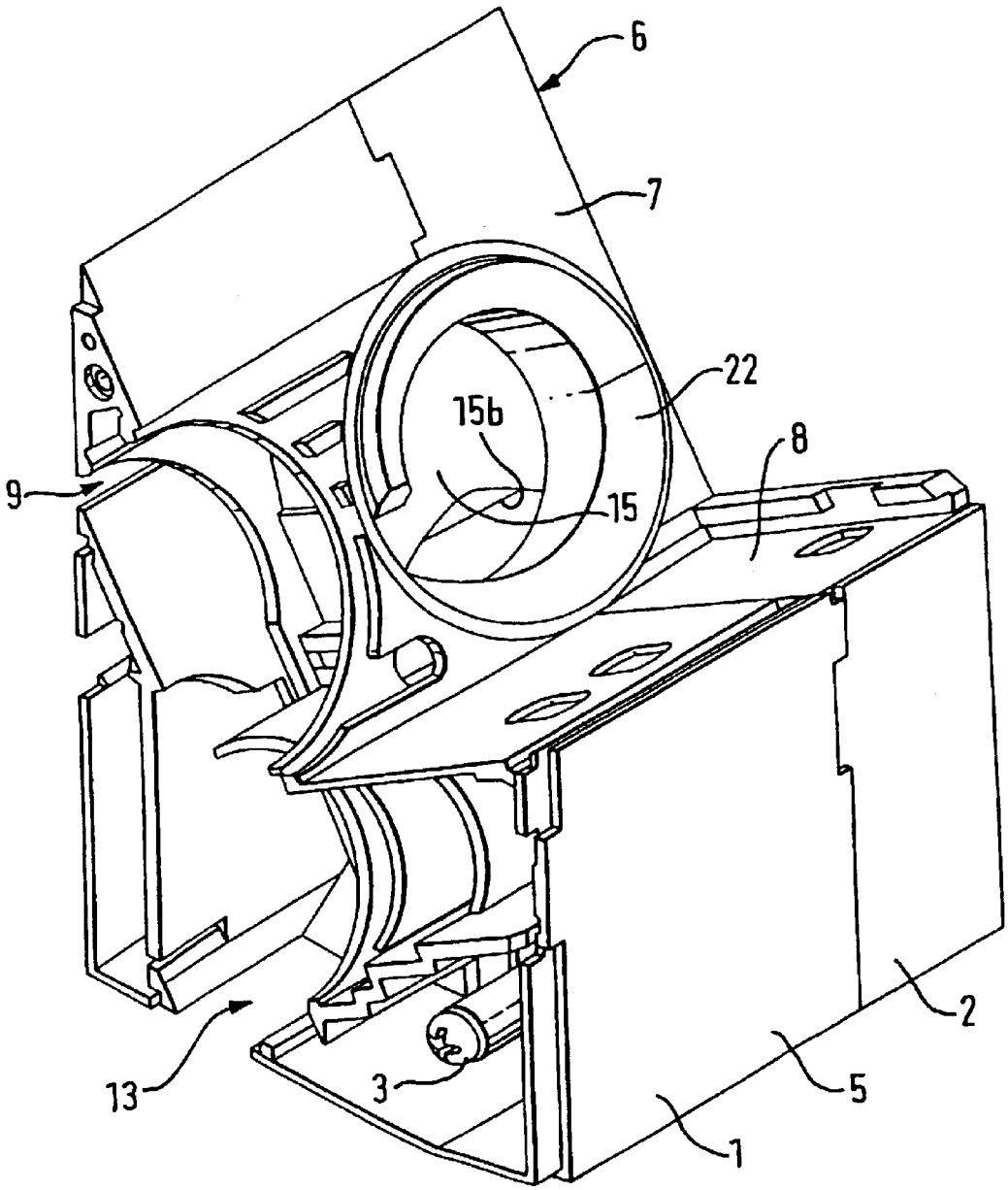
FIG. 1 is a perspective view of a device according to the present invention.
Figure 2:
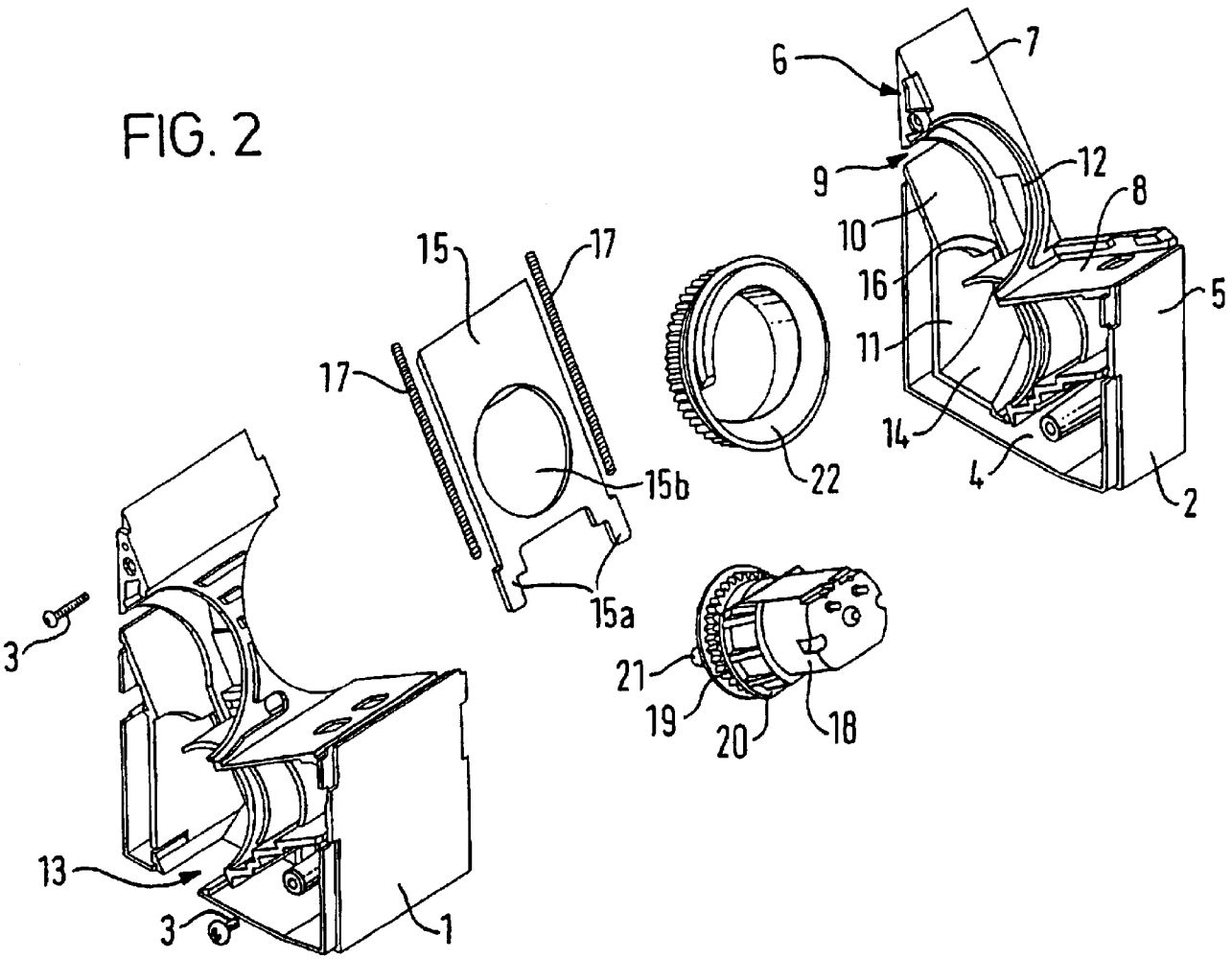
FIG. 2 is an exploded view of the device of FIG. 1.
Figure 3:
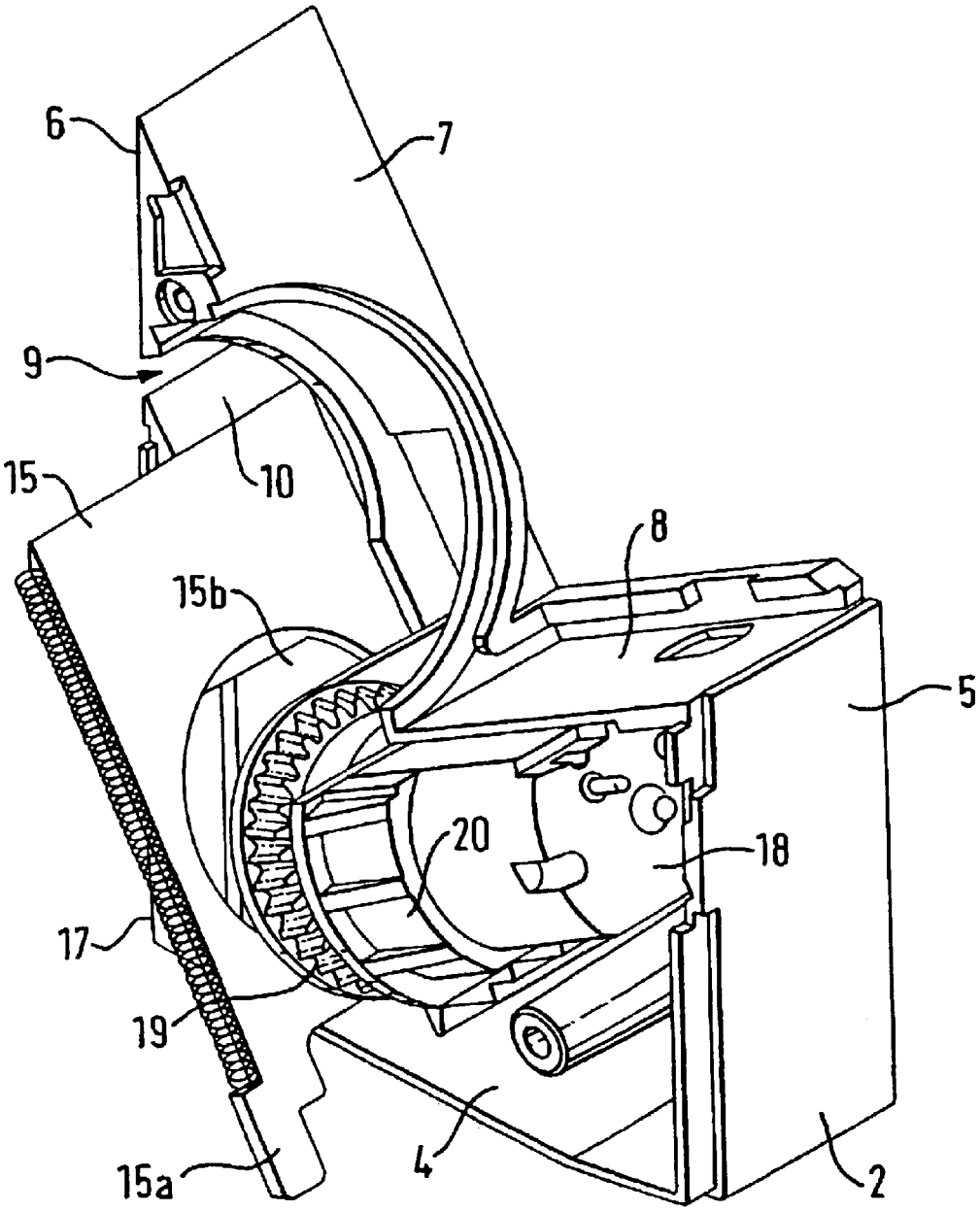
FIG. 3 is a partially cut away view of the device of FIG. 1.

Referring to FIGS. 1, 2 and 3, a coin payout device comprises left and right body portions 1, 2 held together by screws 3. The payout device is adapted to form one end of an array of such devices and, accordingly, the left body portion 1 also serves as the right body portion of an adjacent device. When the body portions 1, 2 are assembled together the device has a flat base 4 and vertical front and rear walls 5, 6. The front wall 5 is approximately half the height of the rear wall 6. A steeply sloping wall 7 descends forwards from the top of the rear wall 6 and meets one end of a gently sloping wall 8 which descends from the top of the front wall 5. The rear wall 6 has a horizontal slot 9 about two-thirds of the way up. A forward sloping internal wall 10 extends from the lower edge of the slot 9. An internal wall 11 extends downwards from the bottom of the sloping internal wall 10. The steeply sloping wall 7 has a round aperture 12 opening onto the sloping internal wall 10. The base 4 has an aperture 13 for the discharge of coins offset to the left. The lower section 14 of the side wall of the right portion 2 is curved to direct coins to the aperture 14.

A plate-like slider 15 is located, by tabs 15*a*, within the device by channels 16 in the left and right body portions 1, 2. The channels 16 extend parallel to the sloping internal wall 10 and the sloping internal wall 10 serves as one wall of the upper parts of the channels 16. When received in the channels 16, the slider 15 can reciprocate, projecting through the slot 9 in the upper region of its travel.

A hole 15*b* extends through the slider from top to bottom. The hole 15*b* is circular at its upper opening. However, its upper portion tapers in so that its lower opening is in the form of a circle with a chord removed from its top.

First and second springs 17 are located in respective channels 16 above the tabs 15*a*.

An electric motor 18 is housed in the device below the gently sloping wall 8. The motor 18 drives a gear wheel 19 via a gearbox 20. An eccentric pin 21 projects from the gear wheel 19 so that the slider 15 can rest on it under the influence of the springs 17. The teeth of the gear wheel 19 mesh with teeth on a coin orienting device 22, mounted in the aperture 12. The coin orienting device 22 accepts randomly oriented coins from a hopper (not shown) and orients them such that each lies parallel to the slider 15 by the time that it is next in line to be transported by the slider 15.

The normal operation of the device shown in FIG. 1 will now be described with reference to FIGS. 4*a* to 4*d*.

In use, the device is connected to a coin hopper (not shown) such as that disclosed in GB-A-2326964. When the motor 18 operates to reciprocate the slider 15, it also rotates the coin orienting device 22. This rotation arranges randomly oriented coins from the hopper into an orderly stack through the middle of the coin orienting device 22.

Figure 4:
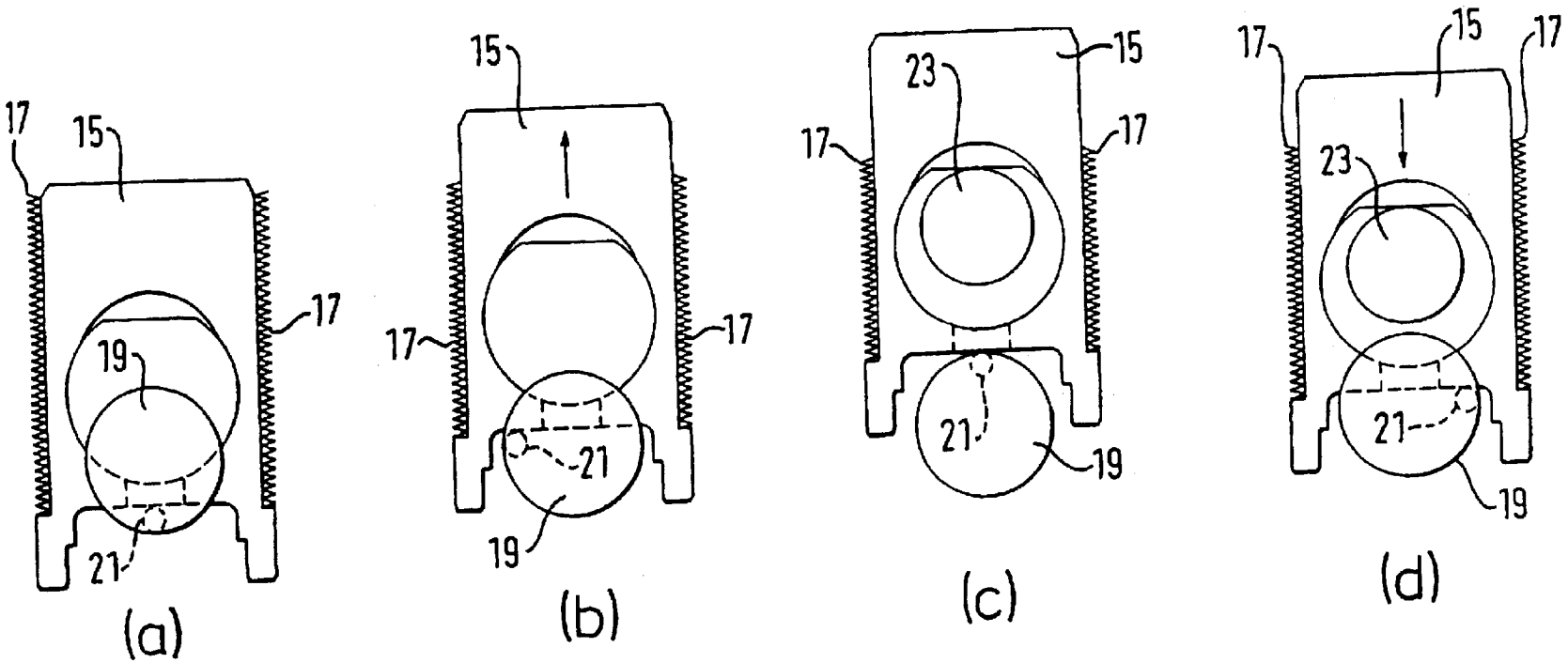
FIGS. 4*a* to 4*d* illustrate the normal operation of the device of FIG. 1.

FIG. 4*a* shows the slider 15 in its parked position. In this state, the gear wheel 19 is positioned so that the pin 21 is in the 6 o'clock position. The slider 15 rests on the pin 21 under the influence of the springs 17 so that the hole 15*b* is clear of the sloping internal wall 10.

When the controller (not shown) of the apparatus, in which the device is mounted, determines that a coin is to be discharged, is energises the motor 18. The energized motor 18 drives the gear wheel 19 clockwise, as viewed in FIG. 3, driving the slider 15 upwards against the springs 17 (FIG. 3*b*).

When the gear wheel 19 has rotated so that the pin 21 is in the 12 o'clock position (FIG. 4*c*), the hole 15*b* is aligned with the coin orienting device 22. Consequently, the first coin 23 in the coin orienting device 22 can move into the hole 15*b*. The first coin 23 may be followed by the second coin. However, the second coin will not be fully received into the hole 15*b* and will project from it.

As the pin 21 leaves the 12 o'clock position, the slider 15 will begin to be driven by the springs 17 towards its parked position. At this time, a second coin, if present, will be ejected from the hole 15*b* back into the coin orienting device 22 by the action of the tapered upper edge of the hole 15*b*.

The motor 18 continues to be energised and rotates the gear wheel 19 so that the pin 21 passes the 3 o'clock position (FIG. 4*d*) and returns to the 6 o'clock position. While the pin 21 is returning to the 6 o'clock position, the springs 17 urge the slider 15 against the pin 21. Consequently, when the pin 21 has reached the 6 o'clock position, the hole 15 will become dear of the sloping internal wall 10 (FIG. 4*a*) allowing the coin 23 to fall from the hole 15 and leave the device via the aperture 13 in its base 4. The return of the slider 15 is detected by a sensor (not shown) and registered by the controller which then de-energises the motor 18.

The operation of the device in the event of a jam will now be described.

Figure 5:
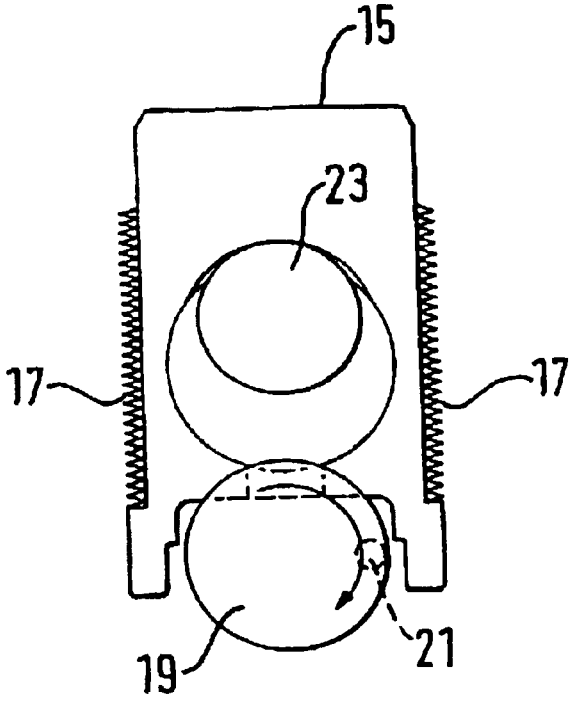
FIG. 5 schematically illustrates the device of FIG. 1 jammed in one manner by a coin.
Figure 6:
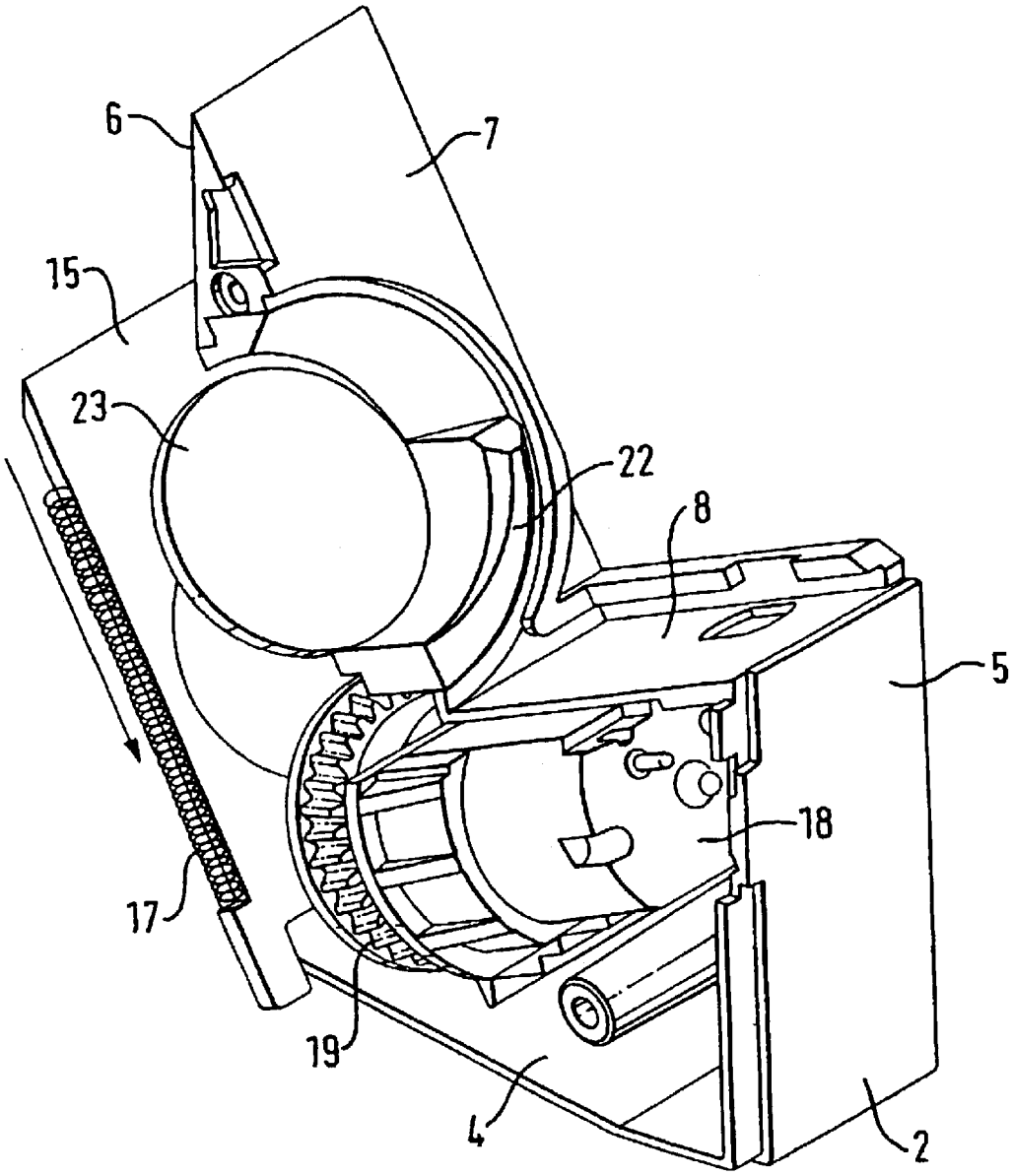
FIG. 6 is a partially cut away view of the device of FIG. 1 jammed by a coin as shown in FIG. 5.

Referring to FIGS. 5 and 6, a coin 23 will occasionally not settle properly into the hole 15*b* or a following coin will fail to be ejected. In these situation, the movement of the slider 15 to its parked position will be prevented by the coin 23 being held between the slider 15 and the coin orienting device 22. Since, the pin 21 is not attached to the slider 15, the stopping of the slider 15 does not prevent the motor 18 running and the pin 21 being returned to the 6 o'clock position. In the event of a jam, when the pin 21 returns to the 6 o'clock position, the sensor will not detect that the slider 15 has returned to its parked position. The controller, therefore, does not de-energise the motor 18 which continues operating and drives the gear wheel 19 through a further revolution. As the gear wheel 19 rotates through this further revolution, the pin 21 re-engages the slider 15 and drives it to the top of its travel. At this point, the coin 23 is given an opportunity to settle properly into the hole 15*b*, if that coin is the cause of the jam. However, if the jam was caused by a following coin, the start of the slider 15 on its return journey provides a second chance for the following coin to be ejected by the tapered part of the edge of the hole 15*b*. The tension in the springs 17 limits the force applied to the slider 15 and consequently limits the force with which a jamming coin 23 is pressed against the coin orienting device 22. The design of the springs 17 is such that this force is limited to a level which will not result in damage or excessive wear in the event of a jam.

Once the jam has been cleared, the operation of the device proceeds normally.

It will be appreciated that many modifications may be made to the embodiment described above. For example, the pin 21 could be driven back and forth in a semi-circular path or linearly. Whilst the coin payout device has been described for use with coins, it can also be used with tokens or other similar coin-like articles which may or may not have an attributable monetary value. It will be understood that the device may be installed in a vending or gaming or amusement machine or used in other situations where coin payouts are carried out.

What is claimed is:

1. A coin payout device comprising:

a transport member having a coin receiving hole in a face thereof for receiving a coin, the transport member being reciprocable between a first position whereat the hole is at a coin discharging station and a second position whereat the hole is at a coin receiving station;

coin orienting means at the coin receiving station for orienting coins for reception by said hole; and a drive means including a rotary prime mover, for driving the transport member from the first position to the second position and for driving the orienting means, wherein the drive means is arranged such that the prime mover will continue to rotate harmlessly, driving the orienting means, when the transport member becomes jammed.

2. A device according to claim 1, including means for gaining potential energy by means of the drive means during driving of the transport member from the first position to the second position, said means for gaining potential energy being employed for driving the transport member between the second position and the first position.

3. A device according to claim 2, wherein the means for gaining potential energy comprises a mechanical energy storage device.

4. A device according to claim 3, wherein the mechanical energy storage device comprises spring means.

5. A device according to claim 1, wherein the transport member is arranged such an opening of the hole is not in a vertical plane.

6. A device according to claim 5, wherein the transport member is planar and the hole extends fully through the transport member.

7. A device according to claim 6, wherein the coin receiving station comprises a coin delivery path for supplying cons on the upper side of the transport member and a wall closing the hole on the under side of the transport member.

8. A device according to claim 7, wherein the hole is open at the under side of the transport member at the coin discharge station so that a coin therein can fall out of the hole.

9. A device according to claim 6, wherein the hole is open at the under side of the transport member at the coin discharge station so that a coin therein can fall out of the hole.

10. A device according to claim 1, wherein the coin orienting means comprises a rotary ring.

11. A device according to claim 10, wherein a tapering passage extends through the coin orienting means, the tapering passage having a circular opening for discharging coins to the transport member and an opening having a periphery in the form of a spiral for receiving coins from a hopper.

12. A device according to claim 11, wherein the coin orienting means comprises a rotary ring.

13. A device according to claim 10, wherein the orienting means includes a coin agitating projection for agitating coins in a hopper supplying coins to the device.

14. A coin hopper including a coin payout device according to claim 1.

15. A vending, gaming or amusement machine including a coin payout device according to claim 1.

16. A coin payout device comprising:

a transport member having a coin receiving hole in a face thereof for receiving a coin, the transport member being reciprocable between a first position whereat the hole is at a coin discharging station and a second position whereat the hole is at a coin receiving station;

a coin orienting device at the coin receiving station for orienting coins for reception by said hole; and a drive mechanism including a rotary prime mover, for driving the transport member from the first position to the second position and for driving the orienting device, wherein the drive mechanism is arranged such that the prime mover will continue to rotate harmlessly, driving the orienting device, when the transport member becomes jammed.

* * * * *